United States Patent [19]

Kishimoto

[11] Patent Number: 4,719,572

[45] Date of Patent: Jan. 12, 1988

[54] FUEL INJECTION CONTROL SYSTEM FOR INTERNAL COMBUSTION ENGINE

[75] Inventor: Yuuji Kishimoto, Hyogo, Japan

[73] Assignee: Mitsubishi Denki Kabushiki Kaisha, Tokyo, Japan

[21] Appl. No.: 758,848

[22] Filed: Jul. 26, 1985

Related U.S. Application Data

[63] Continuation of Ser. No. 406,146, Aug. 9, 1982, abandoned.

[30] Foreign Application Priority Data

Aug. 10, 1981 [JP] Japan ..... 56-125632

[51] Int. Cl.[4] ..... F02M 51/00

[52] U.S. Cl. ..... 364/431.05; 364/431.12; 123/480; 123/486

[58] Field of Search ..... 364/431.05, 431.12; 123/480, 478, 486

[56] References Cited

U.S. PATENT DOCUMENTS

| | | | |
|---|---|---|---|
| 3,838,397 | 9/1974 | Watson et al. | 123/486 |
| 4,099,495 | 7/1978 | Kiencke et al. | 123/486 |
| 4,352,158 | 9/1982 | Date et al. | 123/486 |
| 4,354,238 | 10/1982 | Manaka et al. | 364/431.12 |
| 4,354,239 | 10/1982 | Kanegae | 364/431.05 |
| 4,359,032 | 11/1982 | Ohie | 123/486 |
| 4,387,429 | 6/1983 | Yamauchi et al. | 364/431.05 |
| 4,397,282 | 8/1983 | Salway | 123/486 |
| 4,438,496 | 3/1984 | Ohie | 364/431.05 |

*Primary Examiner*—Gary Chin

*Attorney, Agent, or Firm*—Sughrue, Mion, Zinn, Macpeak & Seas

[57] ABSTRACT

A fuel injection control system for an internal combustion engine in which the amount of fuel injected per input stroke of the engine is precisely controlled so that a predetermined constant air-to-fuel ratio is maintained at all times. A fuel flow arithmetic unit, operating from inputs supplied from a sensor which detects the pressure in the intake manifold of the engine, calculates a fuel flow amount per intake stroke. The output of the fuel flow arithmetic unit is applied as an address input to a memory in which are prestored values of driving times for each value supplied from the fuel flow arithmetic unit. The driving times are calculated taking into account the non-zero opening and closing times of the fuel injection valves, thereby eliminating nonlinearities in the fuel flow amount driving time characteristics. A driving signal generating circuit drives (opens) the fuel injection valves for times indicated by the driving times outputted by the memory.

1 Claim, 6 Drawing Figures

FUEL INJECTION CONTROL SYSTEM FOR INTERNAL COMBUSTION ENGINE

This is a continuation of application Ser. No. 406,146, filed 7/9/82, now abandoned.

BACKGROUND OF THE INVENTION

The present invention relates to a fuel injection control system including an apparatus for driving a fuel injection valve in such a manner that the air-to-fuel ratio of the engine with which the system is used is maintained constant.

FIG. 1 is a block diagram showing an essential portion of a fuel injection control system for an internal combustion engine to which one embodiment of the present invention can be applied. An arithmetic control system 3 receives, as operating parameters, both (1) the output of an engine speed detecting device 7, which generates a pulse each time the crankshaft (not shown) of the engine rotates through a predetermined angle, specifically, for each intake stroke of the engine, and (2) the output of an intake air flow rate detecting device, specifically, a pressure sensor 2 disposed in an intake manifold of the engine downstream of a throttle valve 5. In response to these parameters, the arithmetic control system calculates an approximate driving time of a fuel injection valve 4, disposed downstream of an air cleaner 1, which injects fuel into a cylinder 6 in synchronization with the rotation of the engine.

In the system of FIG. 1, fuel pressurized by a fuel pump 9 is supplied from a fuel tank 10 through a fuel pressure regulator 8 by way of a fuel line 13 to the fuel injection valve 4. The fuel pressure regulator 8 is connected by a line 14 to the intake manifold at a point adjacent the fuel injection valve 4 so that the pressure at the injecting position of the fuel injection valve 4 may be used as the operating pressure of the fuel pressure regulator 8. Pressurized excess fuel is returned to the fuel tank 10 via a fuel line 12. With the described arrangement, the pressures upstream and downstream of the injection valve 4 are held at predetermined levels.

In FIG. 2, which shows an example of a conventional fuel injection control system, reference numeral 20 indicates a sawtooth wave generating circuit which is triggered by the output of the engine speed detecting device 7. The output of the sawtooth wave generating circuit 20 is connected to one input terminal of a comparator 30, the other input terminal of which is connected to the output of the pressure sensor 2 which generates a voltage which is linearly proportional to the absolute pressure in the intake manifold downstream of the throttle valve 5. In this arrangement, the comparator 30 outputs a signal which drives (opens) the fuel injection valve 4 when the output of the sawtooth wave generating circuit 20 is lower than the output of the pressure sensor 2, with the driving of the fuel injection valve 4 commencing from the time the sawtooth wave generating circuit is triggered by the output of the engine speed detecting device 7. The output of the comparator 30 is applied to the fuel injection valve 4 through a driver 40.

This system is constructed and operates upon the assumption that a linear relationship exists among the intake air flow rate, the absolute pressure in the intake manifold, the output voltage of the pressure sensor and the effective driving time of the injection valve during one intake stroke of the engine, and also that a linear relationship exists between the effective driving time of the fuel injection valve and the amount of fuel injected. The amount of fuel injected from the fuel injection valve in one operation is dependent upon the effective area of the valve, the open time of the valve and the pressure of the fuel supplied thereto. Of these parameters, the effective area of the valve is assumed to be an invariable. Therefore, if the fuel pressure is held constant, assumedly a linear relationship exists between the effective driving time of the fuel injection valve and the amount of fuel injected.

The actual relationship, however, between the driving time of the fuel injection valve and the fuel discharge amount in this system is as indicated by a solid curve (a) in FIG. 3. From FIG. 3, it may be seen that a linear relationship, indicated by a broken line (b), is present only for a driving times longer than a minimum time $t_0$. The nonlinearities at driving times shorter than $t_0$ can be attributed to the fact that the effective area of the valve is in a transient state during transitions of the valve between open and closed states. At the drive time $t_0$, the actual effective area of the valve reaches the theoretical fixed effective area. As shown in the graph of FIG. 4 which plots the fuel flow rate of the valve versus times, the injection valve 4 begins to open, following application of the driving signal thereto at $t=0$, at a time $t_2$. After gradually opening to the theoretical fixed area between $t_2$ and $t_3$ and remaining fully open until the end of the calculated driving time at $t_4$, the valve gradually closes until it is completely closed at $t_5$.

The areas A, B and C under the curve in FIG. 4 represent the total amount of fuel injected by the valve in the corresponding time periods. It is the existence of the areas A and C for the periods from $t_2$ to $t_3$ and from $t_4$ to $t_5$ which make the actual relationship between the driving time of the valve and the amount of fuel injected nonlinear. The presence of the areas A and C is unaffected by changing the theoretical fixed effective area of the valve, the fuel pressure, or the fuel line size. In order to reduce the areas A and C to zero to reduce the time $t_0$ to zero, the fuel injection valve would have to be opened and closed at an infinite speed, which is clearly impossible for a valve body having a finite inertia. Moreover, even a significant reduction of $t_0$ would require a very expensive injection valve and driver.

Moreover, a practical fuel injection valve must have a minimum injection (open) period determined by the maximum rotational speed of the engine. Specifically, the valve should be able to open and close about five times within a period defined by $t_1-t_0$ in FIG. 3. However, it is difficult as a practical matter to construct a fuel injection valve which meets this criteria. To compensate, prior art fuel injection systems used a plurality of injection valves or they operated the injection valve only outside of the non-linear region. This was accompanied by a difficulty that the air-to-fuel ratio could not be precisely controlled.

It is thus the primary object of the present invention to eliminate the aforementioned defects of prior art fuel injection systems.

SUMMARY OF THE INVENTION

Overcoming the disadvantages of the prior art systems described above, the invention provides a fuel injection system for an internal combustion engine in which effective driving times for the fuel injection valve are prestored in a memory. The injection valve is driven in accordance with the output of the memory so that no error is present in the air-to-fuel ratio of the intake mixture of the invention, even when the nonlinear region of the injection valve is used. The invention requires none of an expensive injection valve, plural injection valves, or expensive driver needed by the prior art.

DESCRIPTION OF THE PREFERRED EMBODIMENT

Figure 1:
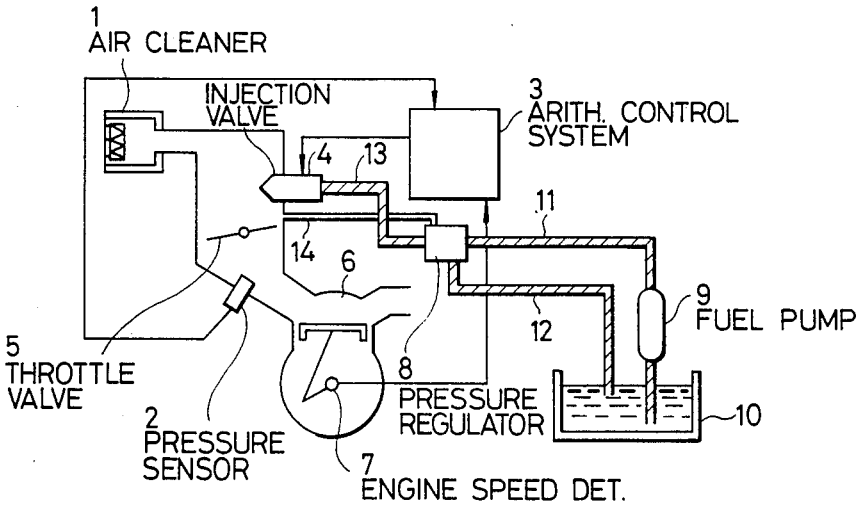
FIG. 1 is a block diagram showing essential portions of a fuel injection system for an internal combustion engine to which the present invention can be applied.
Figure 2:
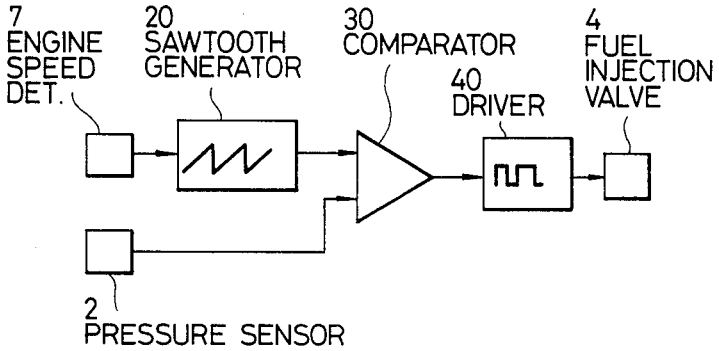
FIG. 2 is a block diagram showing a fuel injection control system according to the prior art.
Figure 3:
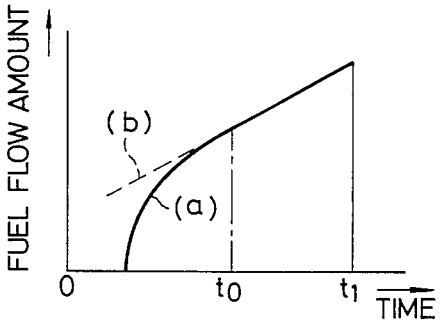
FIGS. 3 and 4 are graphs illustrating characteristics of a fuel injection valve.
Figure 4:
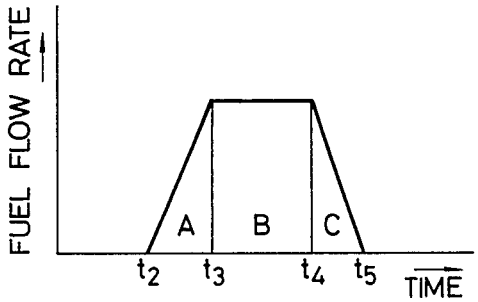
Figure 5:
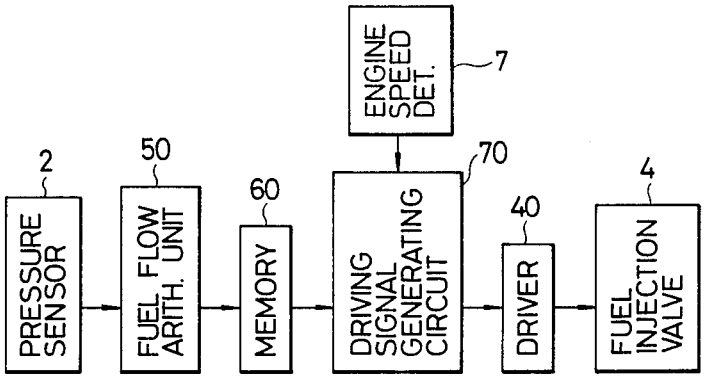
FIG. 5 is a block diagram of a preferred embodiment of a fuel injection control system constructed according to the present invention.

A preferred embodiment of the present invention will be described with reference to FIG. 5. In FIG. 5, elements similar to those of FIG. 2 are indicated with like reference numerals.

Reference numeral 50 indicates a fuel flow arithmetic unit which calculates a desired fuel flow amount in accordance with the flow rate of intake air as indicated by the output of the pressure sensor 2 which detects the pressure in the intake manifold for each intake stroke of the engine. Reference numeral 60 indicates a memory which receives the output of the fuel flow arithmetic unit 50 as an address input and, in response thereto, outputs a numerical value representing the actual driving time of the fuel injection valve. The memory 60 may be implemented with a ROM (Read Only Memory) or other nonvolatile memory device. Elements 50 and 60 may together be implemented by a single IC device 87AD manufactured by Nippon Electric Co., Ltd. Reference numeral 70 indicates a driving signal generating circuit for generating driving signal pulses having a time width determined according to the output values from the memory 60 and which are in synchronization with the pulses of the output signal from the aforementioned engine speed detecting device 7. This device may consist of an Intel 8253 programmable counter. The output from the driving signal generating circuit is applied by the driver 40 to the valve 4.

Figure 6:
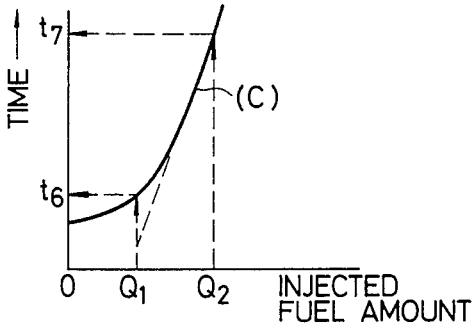
FIG. 6 is a graph illustrating characteristics of an injection valve which are prestored in a memory.

In the described fuel injection system of the invention, the fuel flow arithmetic unit 50, in response to the output of the pressure sensor 2, provides output valves such that a predetermined desired air-to-fuel ratio is maintained, that is, so that the proper amount of fuel is injected during each intake stroke, taking into account the nonlinearities in the characteristics of the fuel injection valve. More specifically the memory 60 is pre-programmed with numerical values representative of the driving time—amount of fuel injected characteristic curve of the injection valve 4. An example of such a curve is shown as a curve c in FIG. 6. For instance, for a calculated fuel amount Q1, the memory 60 outputs a driving time value $t_6$ (nonlinear region), and for a calculated fuel amount Q2, the memory 60 outputs a driving time $t_7$ (linear region). The driving signal generating circuit 70 generates driving signal pulses according to the driving time values $t_6$, $t_7$, etc. applied thereto from the memory 60, in synchronization with the pulses from the engine speed detecting device 7 which occur at each intake stroke of the engine. Thus, the cylinder 6 of the engine is fed with a mixture having a precisely controlled air-to-fuel ratio.

The present invention is not limited to a fuel injection system used with an internal combustion engine in which injection is synchronized with the intake timing, but can also be applied to systems in which the injection valve is driven at a frequency proportional to the flow rate of intake air.

As has been described hereinbefore, according to the present invention, since corrected actual driving time values for the fuel discharge flow rate of the injection valve 4 are prestored in a memory, the fuel injection valve is controlled so that precisely the right amount of fuel is injected at all times. No complicated nonlinear calculations are needed to achieve this effect. Thus, the usable range of the injection valve is extended. As a result, the use of multiple injection valves, the use of an expensive injection valve or the use of an expensive driver is not required. Hence, an inexpensive fuel injection control system for an internal combustion engine is provided. Moreover, the invention is further advantageous in that, merely by changing the injection valve and the memory, engines of different capacities can be accommodated.

What is claimed is:

1. A fuel injection control system for an internal combustion engine provided with a fuel injection valve comprising: means for detecting the intake manifold pressure of said engine and providing an output signal; fuel flow arithmetic unit means for calculating a fuel flow amount in accordance with said output signal of said engine; memory means having an address input coupled to an output of said arithmetic unit means, said memory means storing values of a driving time for corresponding values applied to said address input from said arithmetic unit means; and means for driving said fuel injection valve with driving times determined in accordance with values outputted from said memory means, said outputted values being used to compensate for the non-linearity of the actual relationship between the driving time of said fuel injection valve and the amount of fuel actually injected;

wherein said values stored in said memory means are determined so that said fuel injection valve is driven with driving times such that a predetermined constant air-to-fuel ratio is maintained; and wherein said means for driving said fuel injection valve is synchronized in accordance with output pulses produced by engine speed detecting means.

* * * * *